US006112390A

United States Patent [19]

Takeda et al.

[11] Patent Number: 6,112,390

[45] Date of Patent: Sep. 5, 2000

[54] APPARATUS FOR MANUFACTURING HEMMED WORKPIECES

[75] Inventors: Toshiaki Takeda; Hiroji Chahara; Kazuhiro Terayama; Yasuo Fukagawa, all of Saitama-ken; Michihiro Kitahama, Tochigi-ken; Makoto Kanou, Saitama-ken; Ichiro Oshima, Saitama-ken; Shinji Fujita, Saitama-ken, all of Japan

[73] Assignee: Honda Giken Kogyo Kabushiki Kaisha, Tokyo, Japan

[21] Appl. No.: 09/315,336

[22] Filed: May 20, 1999

[30] Foreign Application Priority Data

| | | | |
|---|---|---|---|
| May 25, 1998 | [JP] | Japan | 10-143005 |
| May 25, 1998 | [JP] | Japan | 10-143006 |
| Mar. 12, 1999 | [JP] | Japan | 11-066077 |
| Mar. 12, 1999 | [JP] | Japan | 11-066078 |

[51] Int. Cl.[7] ..... B23P 21/00; B25B 27/14; B23K 37/04

[52] U.S. Cl. ..... 29/33 K; 29/771; 29/788; 29/796; 219/121.31; 228/6.1

[58] Field of Search ..... 29/33 K, 564, 29/563, 771, 787, 788, 795, 715, 791, 796; 228/4.1, 6.1, 102; 219/243, 121.63, 121.64, 121.45, 121.31; 901/42; 72/220

[56] References Cited

U.S. PATENT DOCUMENTS

| | | | |
|---|---|---|---|
| 4,944,445 | 7/1990 | Zimmer | 228/102 |
| 5,188,276 | 2/1993 | Puruya et al. | 228/6.1 |
| 5,228,190 | 7/1993 | Sawa | 29/715 |
| 5,267,683 | 12/1993 | Hamada et al. | 298/4.1 |
| 5,428,880 | 7/1995 | Tomioka et al. | 29/33 K X |
| 5,742,022 | 4/1998 | Crawford et al. | 901/42 X |
| 5,897,796 | 4/1999 | Forrest | 29/243.58 |
| 5,902,496 | 5/1999 | Alborante | 219/121.64 |

FOREIGN PATENT DOCUMENTS

| | | | |
|---|---|---|---|
| 582117 | 2/1994 | European Pat. Off. | 29/771 |
| 2651699 | 3/1991 | France | 29/788 |
| 2440617 | 3/1975 | Germany | 29/787 |
| 211439 | 12/1982 | Japan | 29/787 |
| 236631 | 10/1987 | Japan | 29/787 |
| 3094926 | 4/1991 | Japan | 29/795 |
| 6182641 | 7/1994 | Japan | 29/771 |
| 96/33040 | 10/1996 | WIPO . | |

*Primary Examiner*—William Briggs
*Attorney, Agent, or Firm*—Armstrong, Westerman, Hattori, McLeland & Naughton

[57] ABSTRACT

A workpiece which is made by integrally combining an outer member and an inner member through hemming is manufactured efficiently in a common apparatus. An outer member and an inner member are combined to alternately subassemble two kinds of workpieces at a common subassembly station. A hemming station is disposed on a downstream side of the subassembly station in a manufacturing line. In this hemming station, a first hemming apparatus for the first kind of workpiece and a second hemming apparatus for the second kind of workpiece are disposed in a side by side relationship with each other. The first kind of workpiece subassembled in the subassembly station and the second kind of workpiece are alternately fed to the first hemming apparatus and the second hemming apparatus by a workpiece feeding robot.

9 Claims, 11 Drawing Sheets

APPARATUS FOR MANUFACTURING HEMMED WORKPIECES

BACKGROUND OF THE INVENTION

1. Field of the Invention

The present invention relates to an apparatus for manufacturing hemmed workpieces. The apparatus manufactures two kinds of workpieces of different shapes, such as a right door and a left door of a motor vehicle, by integrating an inner member and an outer member through hemming work.

2. Description of the Related Art

Doors of a motor vehicle are manufactured in the following manner. Namely, a door inner element which is made up by combining a sash, a stiffener, a beam, or the like to a door inner panel, this door inner element being generically called an "inner member", is combined with a door outer panel which is generically called as an "outer member" to thereby obtain a subassembled door. Then, a fringe (or a peripheral edge) of the door outer panel is subjected to a hemming work (also simply called "is hemmed") to thereby integrate the door outer panel and the door inner element. Thereafter, the hemmed portions on the fringe of the door outer panel are welded.

A right door and a left door of a motor vehicle are not in the same shape but are symmetrical with each other. Therefore, the right door and the left door are ordinarily manufactured in separate manufacturing lines which are prepared exclusively for the respective doors. Since this method results in a higher equipment cost, there is known an apparatus for manufacturing the right door and the left door in a common manufacturing line (see Published Unexamined Japanese Patent Application No. 145217/1978).

This conventional apparatus has a pair of door inner element assembly stations for the right door and the left door which are disposed in parallel with each other. In each of the assembly stations a plurality of door inner element constituting parts such as a door inner panel, a sash, a stiffener, a door beam, or the like are connected to each other. On a downstream side of these door inner element assembly stations, there are disposed the following stations in a line: namely, a subassembly station common to both the right door and the left door, for subassembling the doors by combining the door outer panel and the door inner element together; a hemming station for the right door, in which a hemming apparatus adapted or suitable for the right door is disposed; and a hemming station for the left door, in which a hemming apparatus adapted or suitable for the left door is disposed. Each of the right doors and the left doors is hemmed only in the corresponding hemming station. It means that a door that does not correspond to the particular hemming station is allowed to pass therethrough without being subjected to the hemming work therein.

One cycle of hemming work is made up of the following steps: i.e., a step of feeding a door into the hemming apparatus; a step of closing hemming dies of the hemming apparatus; a step of holding the hemming dies under pressure; a step of opening the hemming dies; and a step of discharging the door out of the hemming apparatus. In case the right door and the left door are respectively manufactured in exclusively prepared manufacturing lines, a right door and a left door, i.e., a total of two doors, can be manufactured in a time (i.e., a cycle time) required for one cycle of the hemming work. However, in the above-described common manufacturing line, only one door can be manufactured in one cycle time, resulting in a poor efficiency.

In view of the above point, the present invention has an object of providing a low-cost apparatus for manufacturing hemmed workpieces in which two kinds of workpieces can be manufactured at a high efficiency.

SUMMARY OF THE INVENTION

In order to attain the above and other objects, the present invention is an apparatus for manufacturing hemmed workpieces which are of two kinds in different shapes formed by integrating an outer member and an inner member by hemming. The apparatus comprises: a common subassembly station for alternately subassembling two kinds of workpieces by combining the outer member and the inner member together; a hemming station having disposed therein in a side by side relationship relative to the subassembly station a first hemming apparatus adapted for a first kind of workpiece and a second hemming apparatus adapted for a second kind of workpiece; a common workpiece feeding robot for feeding the first kind of workpiece and the second kind of workpiece subassembled in the subassembly station alternately into the first hemming apparatus and the second hemming apparatus. While discharging a workpiece and feeding a next workpiece in one of the first and second hemming apparatuses, hemming steps from closing hemming dies to opening the hemming dies are performed in the other of the first and second hemming apparatuses.

According to the present invention, while the following steps are being performed in the first hemming apparatus, i.e., the steps of discharging the first kind of worked workpiece out of the hemming apparatus whose hemming dies have been opened, and feeding into the hemming apparatus the first kind of workpiece subassembled in the subassembly station, the following steps are performed in the second hemming apparatus, i.e., the steps of closing the hemming dies, holding the hemming dies under pressure, and opening the hemming dies. Then, while the following steps are being performed, i.e., the steps of discharging the second kind of worked workpiece from the second hemming apparatus and feeding into the hemming paratus the second kind of workpiece subassembled in the subassembly station, the following steps are performed in the first hemming apparatus, i.e., the steps of closing the hemming dies, holding the hemming dies under pressure, and opening the hemming dies. By repeating the above-described steps, the two kinds of workpieces can alternately be hemmed in a continuous manner. Within a time required for the steps of discharging the workpiece and feeding the workpiece in one of the hemming apparatuses, the steps of closing the hemming dies, keeping the hemming dies under pressure, and opening the hemming dies are performed. The two kinds of workpieces can thus be alternately manufactured at a time interval cf about half the cycle time of the hemming work. As a result, a similar efficiency can be obtained as in the case in which two different workpieces are manufactured in separate manufacturing lines which are exclusively prepared for each kind of the workpieces. In addition, in the present invention, the subassembly station and the workpiece feeding robot are respectively used in common for the two kinds of workpieces, the space efficiency can be improved and the equipment cost can be reduced as compared with the case in which a separate manufacturing line is prepared exclusively for each of the workpieces. The productivity can also be largely improved.

Furthermore, in the present invention, the first hemming apparatus and the second hemming apparatus are alternately operated. In case both the hemming apparatuses are constituted by hydraulic presses, it becomes possible to selectively supply hydraulic pressure from a common hydraulic pressure source to both the hemming apparatuses via a changeover valve. By arranging the hydraulic pressure source in common with each other, a further reduction in cost can be attained.

Conventionally, the feeding of the workpieces into the hemming apparatuses is made by a conveyor. It is, however, difficult to feed two kinds of workpieces by a conveyor while distributing them into a pair of hemming apparatuses which are disposed in a side by side relationship with each other relative to the subassembly station. As a solution, in the present invention, the workpieces are fed into the hemming apparatuses by means of a workpiece feeding robot. Preferably, the workpiece feeding robot further comprises a robot hand mounted at an operating end of the robot, the robot hand having a plurality of clamping devices for clamping bent edge portions of a plurality of sides on a periphery of the outer member of each of the workpieces. When the bent edges are clamped by the clamping devices, the clamping devices serve as inner member pushing devices to prevent the inner member from being lifted from the outer member, so that the positional deviation of the inner member relative to the outer member can be prevented. In addition, the workpiece can be fed into the hemming apparatuses in a state in which the workpiece is lifted or suspended by the movement of the robot hand. As a result, the outer surface of the outer member can be prevented form being scratched. High quality of hemming work can thus be performed.

Preferably, the clamping devices are made up of: a first clamping device for clamping a bent edge portion of a predetermined side of the outer member; second and third clamping devices for clamping bent edge portions of those two oppositely positioned sides of the outer member which face each other in a longitudinal direction in which said predetermined side extends; wherein each of the second and third clamping devices is mounted on each of movable frames which are supported in a manner movable in the direction in which both the sides face each other, and in the longitudinal direction in which both said sides extend. The workpieces of different sizes can thus be held. Further, preferably, each of the second and third clamping devices is supported on each of movable frames so as to be rotatable about an axis which extends in a longitudinal direction of each of the clamping devices. Then, even if the normal direction of clamping points of the bent edge portions of the opposite sides of the outer member may vary with the change in kind of the workpieces, each of the second and third clamping devices is rotated to follow the direction of the clamping points of the bent edge portions. Therefore, each of the clamping points can be surely clamped in the normal direction of each of the second and third clamping devices.

Further, preferably, one of a pair of clamping claws which are provided so as to be opened and closed on each of the clamping devices has a projection and the other thereof has a recession such that the bent edge portion of the outer member is held in a partially deformed manner between the projection and the recession. The bent edge portion can be prevented from sliding or slipping out of the clamping devices due to its own weight. The workpiece can thus be held in a surer manner.

The hemming apparatus is ordinarily constituted by a hydraulic press which is made up of supporting columns vertically provided on four corners of the apparatus and a ram which is suspended, via a hydraulic cylinder, from an upper frame which is extended to bridge these four supporting columns. In case two hemming apparatuses are provided in a side by side relationship with each other, as in the present invention, so that the workpieces can be alternately fed by a common workpiece feeding robot into one of the hemming apparatuses and the other thereof, the following arrangement becomes necessary. Namely, in order to enable the workpiece to be fed without interfering with the supporting column at an intermediate position as seen in the direction of disposing the hemming apparatuses in a side by side relationship with each other, the workpiece feeding robot must be shifted in position to the side of one of the hemming apparatuses and to the side of the other thereof. This time which is required for shifting the robot becomes a time loss and, as a consequence, the time required to feed the workpiece into the hemming apparatus becomes long. This fact becomes a hindrance to a further improvement in the efficiency.

As the conventional hydraulic press, there is known one which comprises supporting columns vertically provided only on diagonally opposite two corners and a ram suspended via a hydraulic cylinder from an upper beam extended between the two supporting columns. If each of the hemming apparatuses is constituted by this kind of hydraulic press, and both the hemming apparatuses are disposed in parallel with each other in such a manner that said upper beams of both the hemming apparatuses are arranged into a V-shape opening toward a side in which the workpiece feeding robot is disposed, there are present, on the side facing the portion of disposing the workpiece feeding robot in both the hemming apparatuses, only supporting columns on both outer sides in the direction of disposing the hemming apparatuses in a side by side relationship with each other. The intermediate portion between the supporting columns remains to be an open space without a supporting column at all. Therefore, by disposing the workpiece feeding robot at an intermediate portion in the direction of disposing both the hemming apparatuses, two kinds workpieces can be alternately fed to both the hemming apparatuses. In this manner, the time required in feeding the workpieces to both the hemming apparatuses can be reduced and a further increase in the efficiency an be attained.

Further, preferably, the apparatus further comprises a common outer member transfer apparatus which alternately transfers the outer member for the first kind of workpiece and the outer member for the second kind of workpiece into the subassembly station; and an inner member transfer apparatus which alternately transfers the inner member for the first kind of workpiece and the inner member for the second kind of workpiece into the subassembly station. The inner member is combined by the inner member transfer apparatus to the outer member transferred into the subassembly station. The inner member transfer apparatus and the outer member transfer apparatus can thus be used in common for the two kinds of workpieces. The cost can thus be further decreased.

In case the cycle time required for predetermined works such as reinforcing welding work, sealing agent applying work, or the like to be applied to the inner member becomes long, it becomes necessary to provide an inner member working line which is prepared exclusively for each kind of works for the workpiece. In such a case, the apparatus preferably further comprises a common inner member assembly station having a pair of inner member setting jigs respectively for the first kind of workpiece and for the second kind of workpiece, each of the inner member setting jigs being capable of setting a plurality of inner member constituting parts in a predetermined positional relationship and being disposed so as to be alternately changed in position between a setting position for performing setting work on each of the inner member setting jigs and a welding position for welding the plurality of inner member constituting parts on the inner member setting jigs to thereby assemble the inner member; and a pair of working lines for the first kind of workpiece and for the second kind of workpiece for performing predetermined works on the inner member taken out of the inner member setting jig positioned at the welding position. The inner member of the first kind of workpiece and the inner member of second kind of workpiece alternately discharged from both the inner member working lines are transferred to the subassembly station by the inner member transfer apparatus. In this arrangement, the inner member assembly station can be used in common for the two kinds of workpieces, whereby the reduction in cost can be attained. Further, the following is possible with this arrangement. Namely, when the inner member setting jig for the first kind of workpiece is rotated in position to the setting position, the inner member constituting parts for the first kind of workpiece can be set in position on the inner member setting jig for the first kind of workpiece. When the inner member setting jig for the second kind of workpiece is turned round or reversed in position to the setting position, the inner member constituting parts for the second kind of workpiece can be set in position on the inner member setting jig for the second kind of workpiece. In this arrangement, it is not necessary to provide the workers for performing the setting work of the inner member constituting parts by distributing them for each of the workpieces. This improves the saving in manpower.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

An explanation will now be made about an embodiment in which the present invention is applied to an apparatus for manufacturing right and left doors of a motor vehicle.

Figure 1:
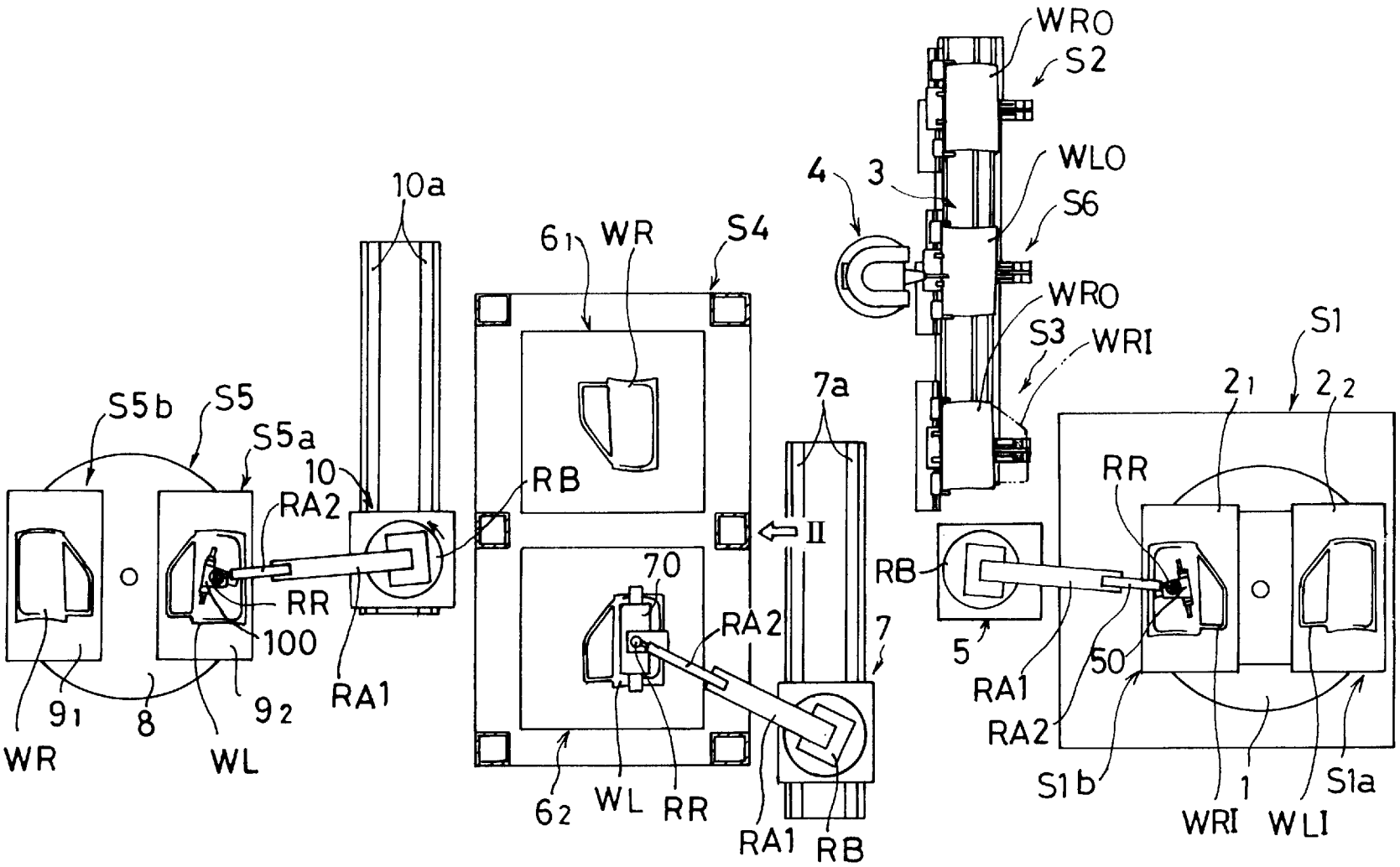
FIG. 1 is a plan view of a first embodiment of an apparatus for manufacturing doors to which the present invention is applied.

As shown in FIG. 1, the apparatus for manufacturing doors is provided with: an inner member feeding station S1 into which door inner elements, generically called as inner members, for vehicle doors are fed or supplied; an outer member feeding station S2 into which outer panels, generically called as outer members, for vehicle doors are fed or supplied; a subassembly station S3 in which the door inner elements are combined with the door outer panels to thereby subassemble the vehicle doors; a hemming station S4 in which those bent edge portions on an outer periphery of the door outer panels which are bent up (or erected by bending) are hemmed, whereby the door outer panels and the door inner elements are integrated together; and a welding station S5 in which the hemmed portions are welded.

In the inner member feeding station S1, there is disposed a turn table 1. On this turn table 1 there are mounted a first door inner element setting jig $\mathbf{2}_1$ for the right door WR and a second door inner element setting jig $\mathbf{2}_2$ for the left door WL. By rotating the turn table 1, both the door inner element setting jigs $\mathbf{2}_1$, $\mathbf{2}_2$ are alternately turned round (or reversed) in position between a setting position S1*a* on one peripheral (or diametrical) side of the turn table 1 and a discharging position S1*b* on the other peripheral side (or on the diametrically opposite side) of the turn table 1. At the setting position S1*a*, a corresponding door inner element WRI, WLI are manually set in position on each of the door inner element setting jigs $\mathbf{2}_1$, $\mathbf{2}_2$. By turning the turn table 1, the door inner element WRI for the right door and the door inner element WLI for the left door are alternately supplied to the discharging position S1*b*.

Into the outer member feeding station S2, there is: manually fed a door outer panel WRO for the right door and a door outer panel WLO for the left door in an alternate manner in a horizontal posture in which the inner surface of the door outer panel WRO, WLO looks upward. By means of a common conveyor apparatus 3, generically called as an outer member transfer apparatus, which is disposed between the outer member feeding station S2 and the subassembly station S3, the door outer panel WRO for the right door and the door outer panel WLO for the left door are alternately transferred in a horizontal posture from the outer member feeding station S2 to the subassembly station S3 via a sealing station S6. In the sealing station S6 a sealing agent is applied or coated by a sealing robot 4 to the connecting portions to connect the door outer panel WRO, WLO to the door inner element WRI, WLI.

Between the inner member feeding station S1 and the subassembly station S3, there is disposed a common door inner element transfer robot 5 which is generically called as a common inner member transfer apparatus. The door inner element WRI for the right door and the door inner element WLI for the left door, which are alternately fed into the discharging position S1*b*, are transferred to the subassembly station S3 by the door inner element transfer robot 5. The door inner element WRI, WLI are respectively combined to corresponding door outer panel WRO, WLO which are alternately fed by the conveyor apparatus 3 into the subassembly station S3 from an upper side by the door inner element transfer robot 5. The right door WR and the left door WL are thus alternately subassembled.

In the hemming station S4, a first hemming apparatus $\mathbf{6}_1$ for the right doors WR and a second hemming apparatus $\mathbf{6}_2$ for the left doors WL are disposed in a side by side relationship with each other relative to the subassembly station S3. The right door WR and the left door WL which are alternately subassembled in the subassembly station S3 are alternately fed to the first hemming apparatus $\mathbf{6}_1$ and to the second hemming apparatus $6_2$ by a common workpiece feeding robot 7 which is disposed between the subassembly station S3 and the hemming station S4. The hemming work of the right door WR by the first hemming apparatus $6_1$ and the hemming work of the left door WL by the second hemming apparatus $6_2$ are alternately performed.

In the welding station S5 there is disposed a turn table 8. On the turn table 8 there are disposed a first welding jig $9_1$ for the right door WR and a second welding jig $9_2$ for the left door WL. By turning the turn table 8, the first welding jig $9_1$, and the second welding jig $9_2$ are alternately turned round or reversed in position between a welding position S5*a* on the side of the hemming station S4 and a discharging position S5*b* on the diametrically opposite side of the welding position S5*a*. Between the welding station S5 and the hemming station S4 there is disposed a common workpiece discharging robot 10 for alternately discharging the right door WR hemmed in the first hemming station $6_1$ and the left door WL hemmed in the second hemming station $6_2$. When the right door WR is to be discharged, the first welding jig $9_1$ is turned round to the welding position S5*a* and the right door WR is transferred to the first welding jig $9_1$ by the workpiece discharging robot 10. When the left door WL is to be discharged, the second welding jig $9_2$ is turned round to the welding position S5*a* and the left door WL is transferred to the second welding jig $9_2$ by the workpiece discharging robot 10. Then, in the welding position S5*a*, the hemmed portions are subjected to spot welding by means of a plurality of welding guns (not illustrated) which are provided in each of the welding jigs $9_1$, $9_2$. At the discharging position S5*b* each of the doors WR, WL is removed from each of the welding jigs $9_1$, $9_2$ and is discharged to the next step.

Figure 2:
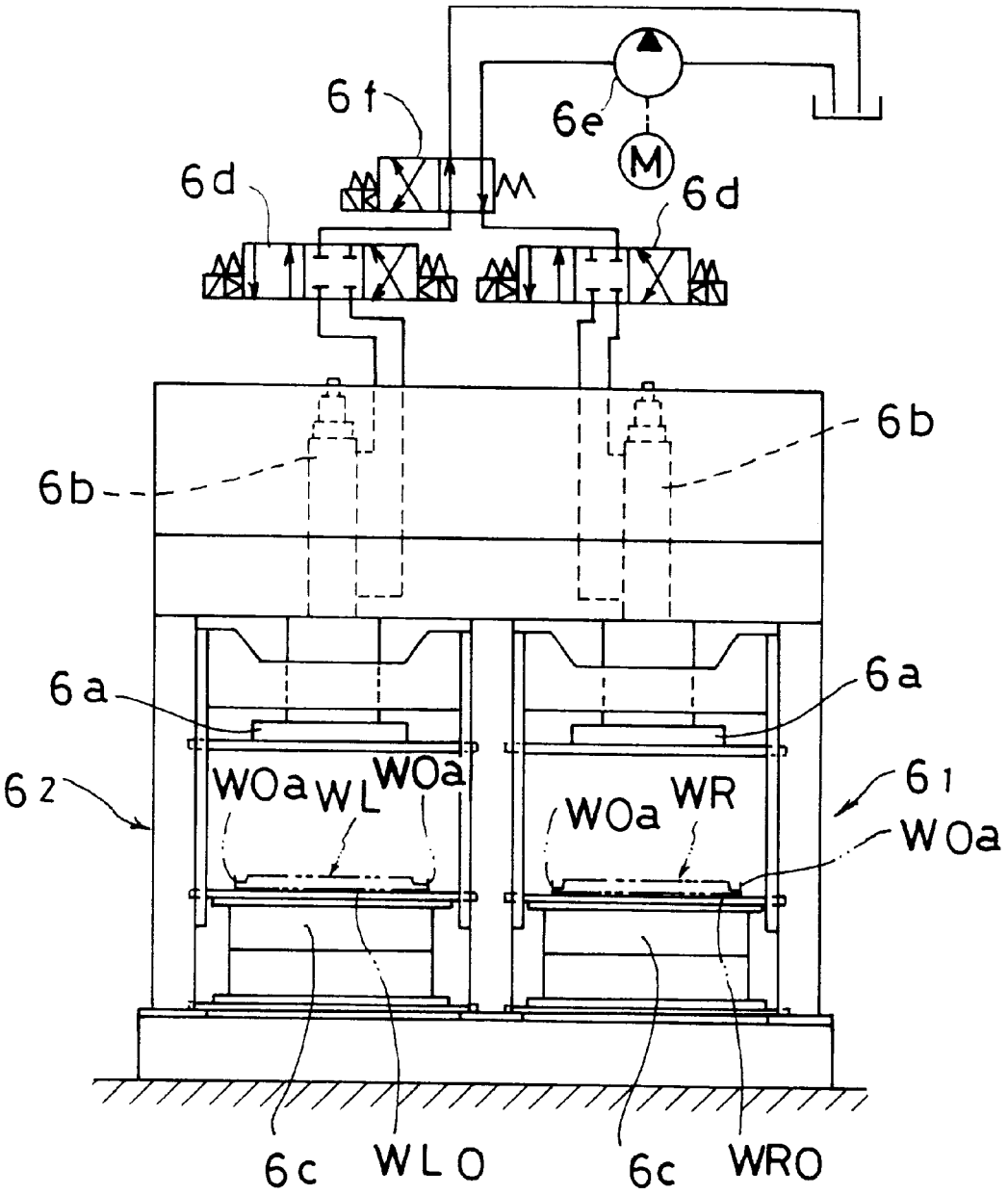
FIG. 2 is a front view of a hemming station as viewed in the direction of an arrow II in FIG. 1.

Each of the first and second hemming apparatuses $6_1$, $6_2$ is made up, as shown in FIG. 2, of a hydraulic press which moves up and down a ram 6*a* with a hydraulic cylinder 6*b*. Bent edge portions WOa of the door outer panel WRO, WLO of each of the doors WR, WL which are set in position on a hemming die 6*c*, is subjected to a hemming work as a result of the lowering movement of the ram 6*a* via a hemming punch (not illustrated) which is interlocked with the movement of the ram 6*a*. A valve 6*d*, 6*d* for upward and downward movement is respectively connected to the hydraulic cylinder 6*b*, 6*b* of the first and second hemming apparatuses $6_1$, $6_2$. Hydraulic pressure from a common hydraulic pressure source 6*e* which is made up of an electrically operated hydraulic pump is selectively supplied to both the lifting valves 6*d*, 6*d* via a changeover valve 6*f*.

One cycle of the hemming work of each of the doors WR, WL is made up of the following steps: i.e., a step of feeding the door WR, WL to the hemming apparatus $6_1$, $6_2$ to set it in position on the hemming die 6*c*; a step of closing the hemming dies by lowering the ram 6; a step of holding the hemming dies under pressure (i.e., keeping the hemming dies pressurized) by maintaining the ram 6*a* at a lower end position; a step of opening the hemming dies by lifting the ram 6*a*; and a step of discharging the door WR, WL out of the hemming apparatus $6_1$, $6_2$ by lifting the door WR, WL off the hemming die 6*c*. It takes about 20 seconds from the start of the step of closing the hemming dies to the end of the step of opening the hemming dies.

In this embodiment, the following procedures are followed. Namely, while discharging the right door WR from the first hemming apparatus $6_1$ by the workpiece discharging robot 10 and while feeding the next right door WR into the first hemming apparatus $6_1$ by the workpiece feeding robot 7, the steps of closing the hemming dies, keeping the hemming dies under pressure, and opening the hemming dies of the second hemming apparatus $6_2$ are performed. Then, while discharging the left door WL from the second hemming apparatus $6_2$ by the workpiece discharging robot 10, and while feeding the next left door WL into the second hemming apparatus $6_2$ by the workpiece feeding robot 7, the steps of closing the hemming dies, keeping the hemming dies under pressure, and opening the hemming dies of the first hemming apparatus $6_1$ are performed. The above-described steps are repeated to thereby alternately hem the right doors WR and the left doors WL in a continuous manner. According to this arrangement, it is possible to perform in an overlapped manner the discharging step and the feeding step in one of the first hemming apparatus $6_1$ and the second hemming apparatus $6_2$, and the steps of closing the hemming dies, keeping the hemming dies under pressure, and opening the hemming dies in the other of the first hemming apparatus $6_1$ and the second hemming apparatus $6_2$. As a result, the right doors WR and the left doors WL can be efficiently manufactured at a time interval of about 20 seconds.

Figure 3:
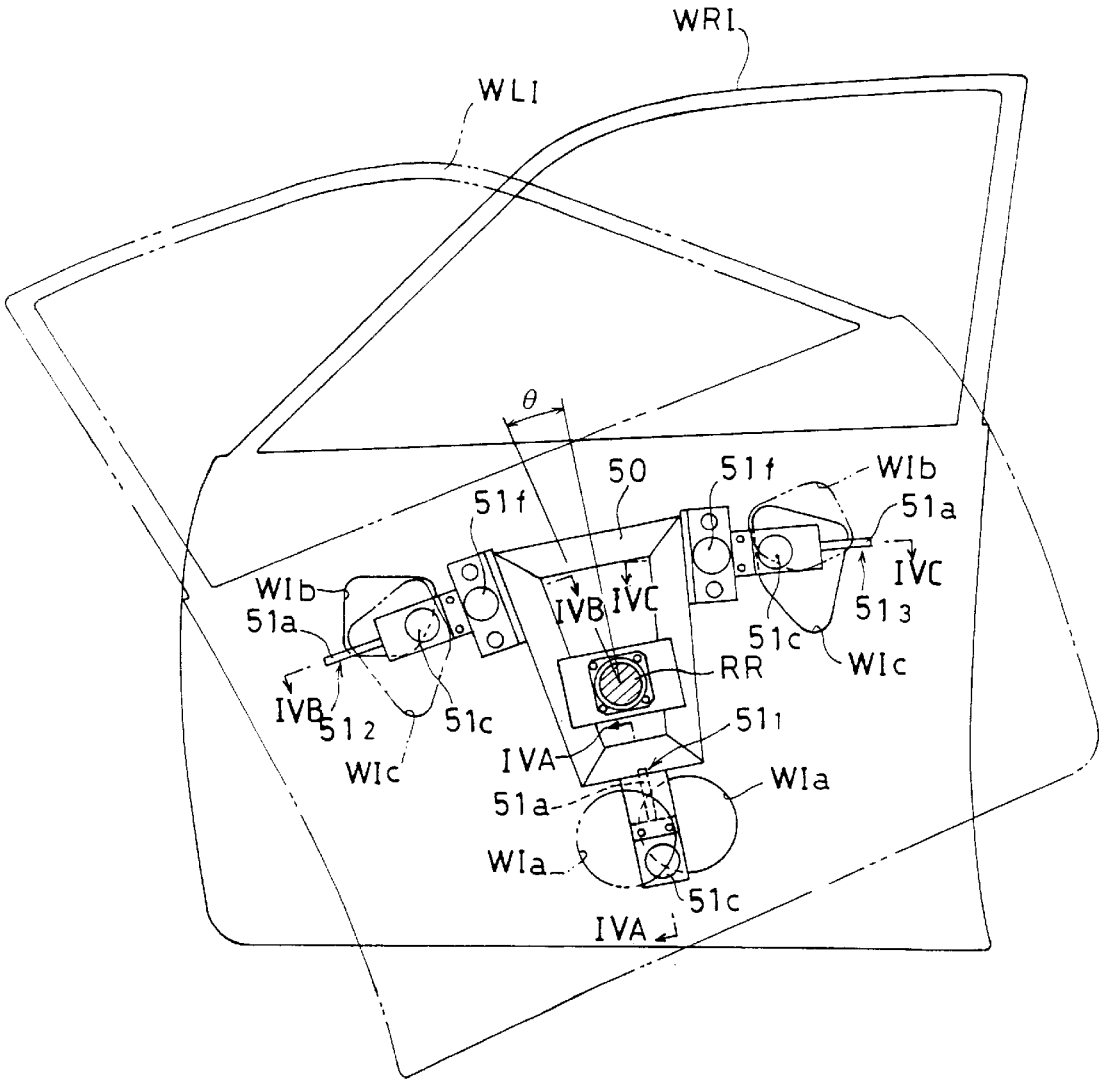
FIG. 3 is a plan view of a robot hand of an inner member transfer robot.
Figure 4A:
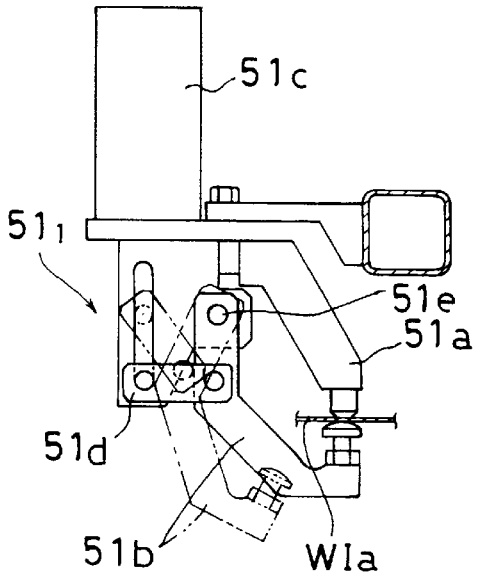
FIG. 4A is a sectional view taken along the line IVA—IVA in FIG. 3.
Figure 4B:
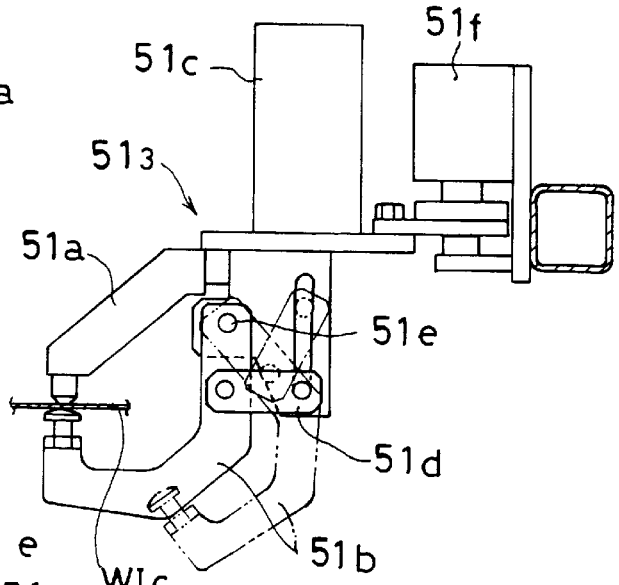
FIG. 4B is a sectional view taken along the line IVB—IVB in FIG. 3.
Figure 4C:
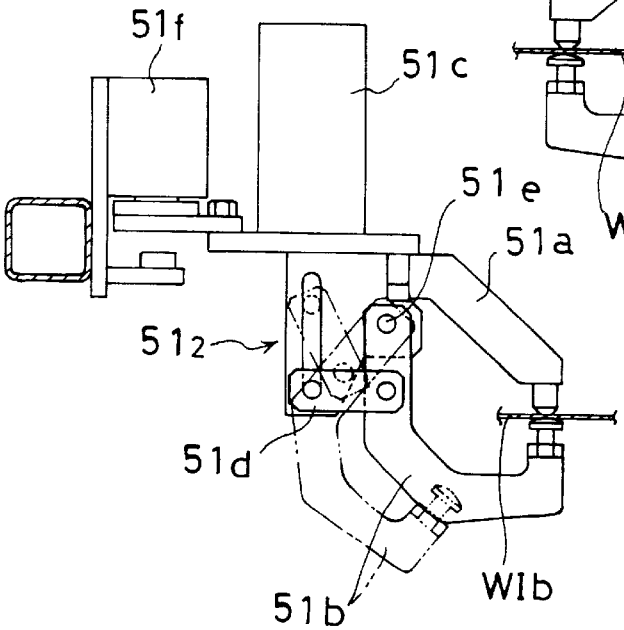
FIG. 4C is a sectional view taken along the line IVC—IVC in FIG. 3.

Each of the above-described door inner element transfer robot 5, the workpiece feeding robot 7, and the workpiece discharging robot 10 is constituted by a 6-axis robot having: a robot main body RB which is rotatable about a vertical axis; a first root arm RA1 which is mounted on an upper end of the robot main body RB so as to be swingable about a horizontal axis; a second robot arm RA2 which is mounted on a front end of the first robot arm RA1 so as to be swingable about a horizontal axis; and a 3-axis wrist RR which is mounted on a front end of the second robot arm RA2. A robot hand 50, 70, 100 is mounted on the wrist RR which is generically called as an operating end of each of the robots 5, 7, 10. The robot hand 50 of the door inner element transfer robot 5 is provided, as shown in FIG. 3, with first through third, i.e., a total of three, holding devices $51_1$, $51_2$, $51_3$ for holding hole edge portions of predetermined three holes WIa, WIb, WIc out of a plurality of holes formed in the door inner panel of the door inner element WRI, WLI. As shown in FIGS. 4A, 4B and 4C, each of these holding devices $51_1$, $51_2$, $51_3$ is provided with a stationary clamp arm 51*a* which contacts an upper surface of the hole edge portion of each of the holes WIa, WIb, WIc, and a movable clamp arm 51*b* which contacts a lower surface of the hole edge portion so as to clamp the hole edge portion between the stationary clamp arm 51*a* and the movable clamp arm 51*b*. The movable clamp arm 51*b* is arranged to be movable to be opened and closed by a cylinder 51*c* with an axis 51*e* serving as a fulcrum.

When the door inner element WRI for the right door as shown by solid lines in FIG. 3 is held, the hole edge portion of the first hole W1*a* which lies on a lower side in a state in which the door is actually mounted on the vehicle is held by the first holding device $51_1$, the hole edge portion of the second hole W1*b* which lies on a front side in a state in which the door is actually mounted on the vehicle is held by the second holding device $51_2$, and the hole edge portion of the third hole W1*c* which lies on a rear side in a state in which the door is actually mounted on the vehicle is held by the third holding device $51_3$, respectively. When the door inner element WLI for the left door as shown by dotted lines in FIG. 3 is held, the robot hand 50 is rotated by the movement of the wrist RR by a predetermined angle e relative to the door inner element, and the hole edge portion of the first hole WIa is held by the first holding device $51_1$, the hole edge portion of the third hole WIc is held by the second holding device $51_2$, and the hole edge portion of the second hole WIb is held by the third holding device $51_3$, respectively. The plane on which the second hole WIb is formed and the plane on which the third hole WIc is formed are not on the same plane. Therefore, the second holding device $51_2$ and the third holding device $51_3$ are respectively mounted so as to be vertically adjustable in position by a cylinder 51*f* relative to the robot hand 50. The positional relationship in the vertical direction between the second holding device $51_2$ and the third holding device $51_3$ of the door inner element WRI for the right door is reversed in position as compared with that of the door inner element WLI for the left door.

The workpiece feeding robot 7 is movable along guide rails 7*a* between that feeding position for the right door WR which lies on the side of the first hemming apparatus $6_1$ and that feeding position for the left door WL which lies on the side of the second hemming apparatus $6_2$.

The subassembly station S3 is disposed near the feeding position for the right door WR. The workpiece feeding robot 7 is moved to this position, and the door is lifted by the robot hand 70 out of the subassembly station S3. In case the door is the right door WR, the door is fed to the first hemming apparatus $6_1$ while keeping the robot 7 in that position. In case the door is the left door WL, the robot 7 is moved to the feeding position for the left door WL and then the door is fed to the second hemming apparatus $6_2$.

Figure 5:
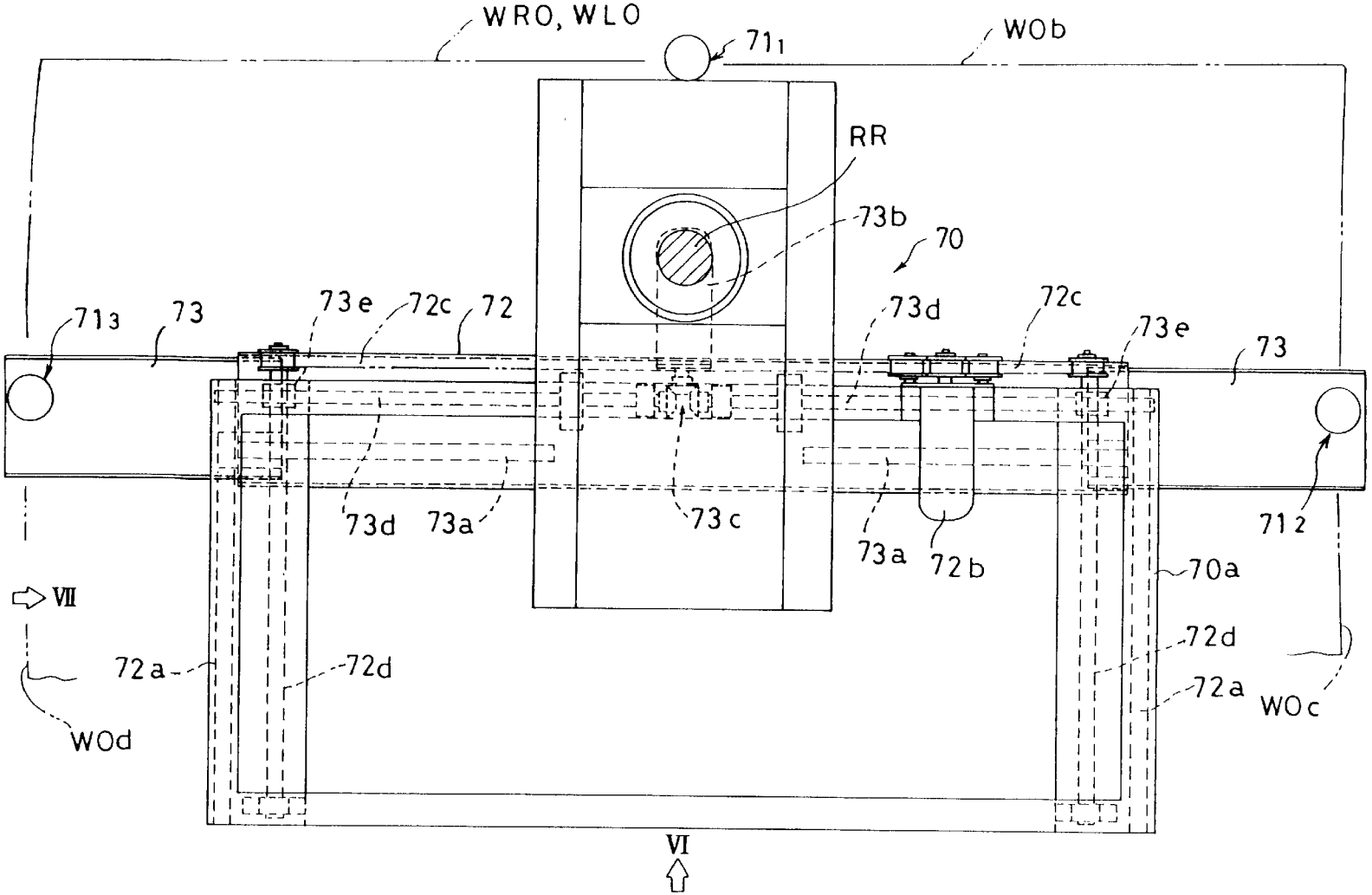
FIG. 5 is a plan view of a robot hand of a workpiece feeding robot.
Figure 6:
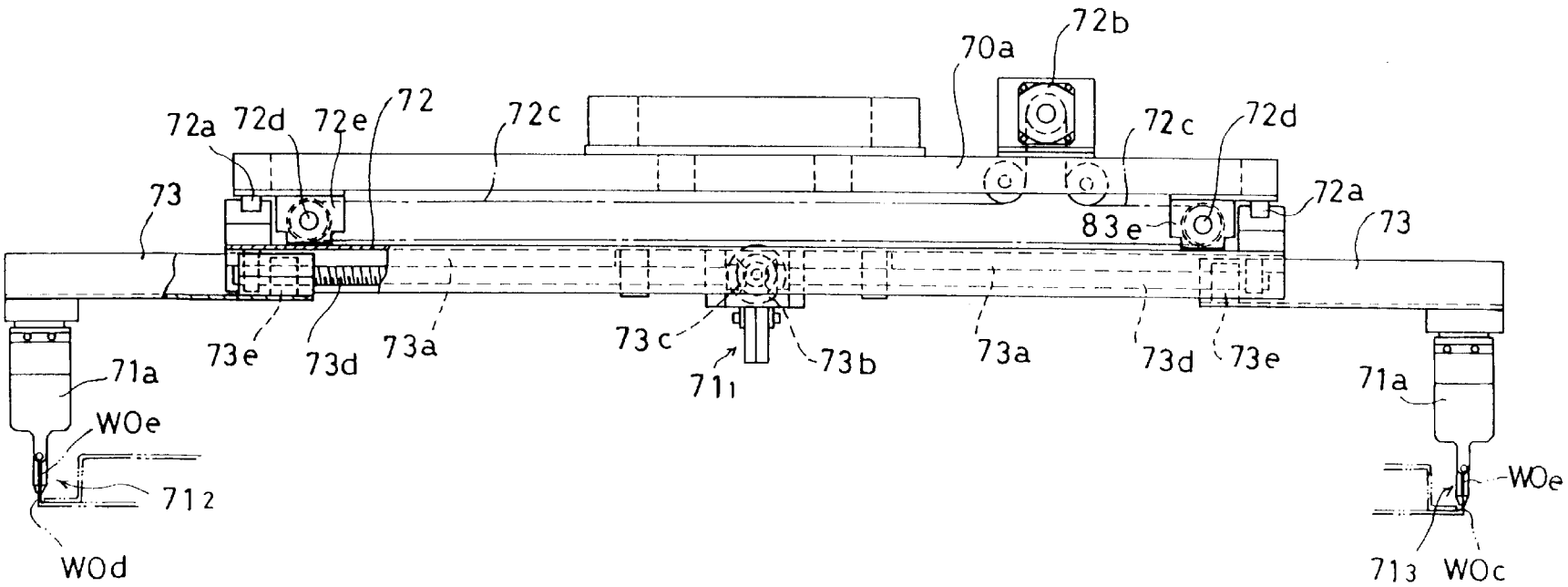
FIG. 6 is a plan view of a robot hand as viewed in the direction of an arrow VI in FIG. 5.
Figure 7:
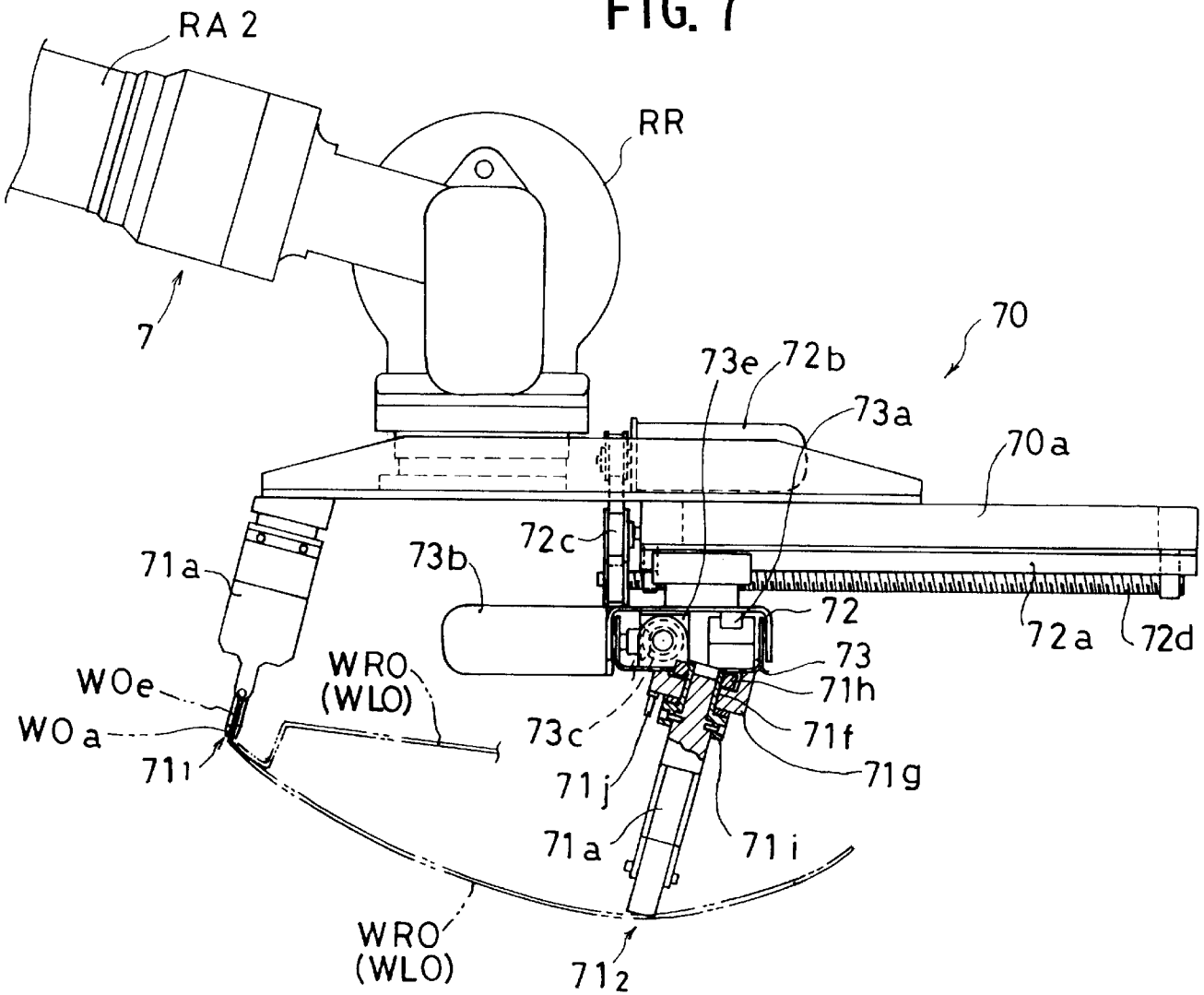
FIG. 7 is a side view of a robot hand as viewed in the direction of an arrow VII in FIG. 5.
Figure 8:
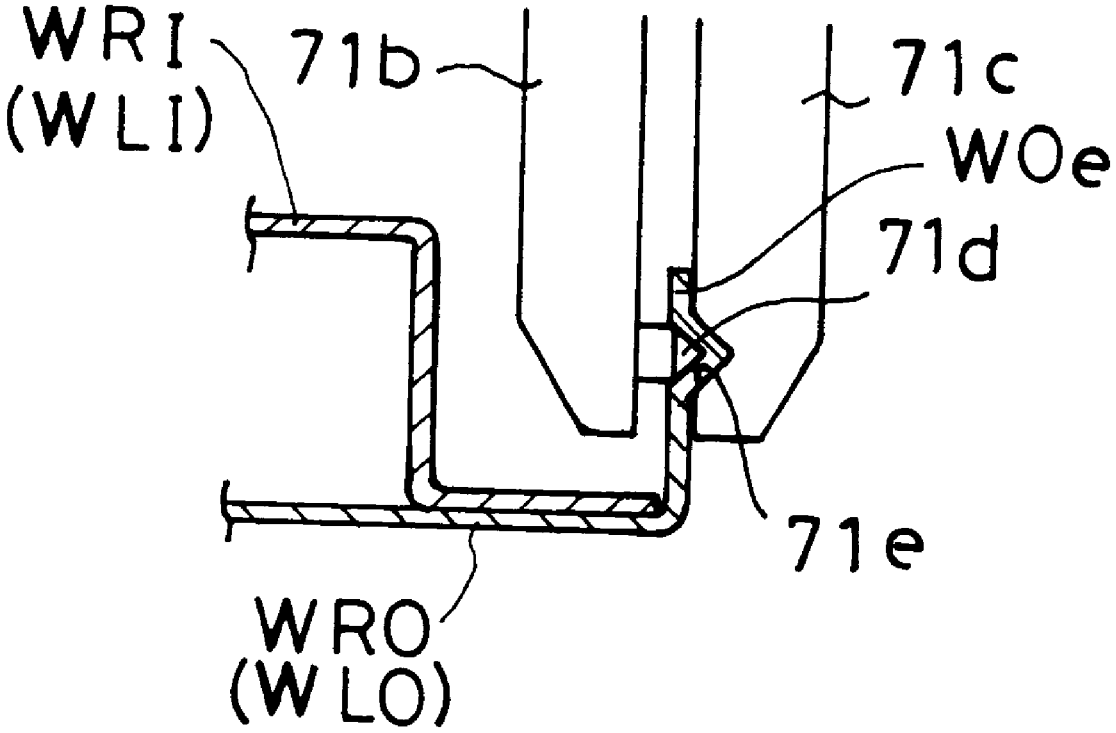
FIG. 8 is an enlarged view of a lower end portion cf a clamping device which is attached to the robot hand in FIG. 5.

As shown in FIGS. 5 through 7, there are mounted on the robot hand 70 the following clamping devices, i.e.: a first clamping device $71_1$ for clamping a bent edge portion WOa of that first side WOb of the door outer panel WRO, WLO which lies on the lower side when the door is actually mounted on the vehicle body; a second clamping device $71_2$ for clamping a bent edge portion WOa of a second side WOc which is one of the facing (or opposing) sides lying opposite to each other on both longitudinal ends of the first side WOb of the door outer panel WRO, WLO; and a third clamping device $71_3$ for clamping a bent edge portion WOa of a third side WOd, i.e., the other of the above-described facing sides of the door outer panel WRO, WLO. Each of the clamping devices $71_1$, $71_2$, $71_3$ is provided with a pair of clamping claws 71*b*, 71*c*, as shown in FIG. 8, which are opened and closed by means of a toggle link mechanism (not illustrated). A projection 71*d* is provided in one of the clamping claws 71*b*, 71*c* and a recession (or a dent) 71*e* is provided in the other of the clamping claws 71*b*, 71*c*. The bent edge portion WOa of the door outer panel WRO, WLO is clamped in a slightly deformed manner between the projection 71*d* and the recession 71*e*. In this manner, the bent edge portion WOa can be prevented from sliding or slipping off the clamping device $71_1$, $71_2$, $71_3$ out of its own weight of the door. By clamping the bent edge portion WOa of each of the above sides WOb, WOc, WOd of the door outer panel WRO, WLO with each of the clamping devices $71_1$, $71_2$, $71_3$, the clamping claw 71*b* on the inner side also functions as a workpiece pushing device which prevents the door inner element WRI, WLI from being lifted. Consequently, the positional deviation of the door inner element WRI, WLI relative to the door outer panel WRO, WLO can be prevented.

In order to enable to handle doors of different sizes, each of the second clamping device $71_2$ and the third clamping device $71_3$ is supported so as to be movable, relative to the robot hand 70, in the direction in which both the second and third sides WOc, WOd of the door outer panel WRO, WLO face each other as well as in the longitudinal direction of both the sides WOc, WOd. In more detail, the robot hand 70 is provided with a slide frame 72 which is movable in the longitudinal direction of the second and third sides WOc, WOd. On the slide frame 72 there are supported a pair of movable frames 73, 73 which are movable in the direction in which both the second and third sides WOc, WOd of the door outer panel WRO, WLO face each other. On each of the movable frames 73, 73, each of the second and third clamping deices 712, 713 is mounted. The slide frame 72 is slidably supported by a pair of guide rails 72*a*, 72*a* which are fixed to the base frame 70*a* of the robot hand 70 connected to the wrist RR. On the base frame 70*a*, an electric motor 72 is mounted, and a pair of ball screws 72*d*, 72*d* which are driven by the electric motor 72*b* via a belt 72*c* are rotatably supported on the base frame 70*a*. The pair of ball screws 72*d*, 72*d* are inserted in a threaded manner into a pair of nuts 72*e*, 72*e* which are fixed to the slide frame 72. In this manner, both the movable frames 73, 73 can be moved by the eclectic motor 72*b* via the slide frame 72 in the longitudinal direction of both the sides WOc, WOd. Each of the movable frames 73 is slidably supported on each of the guide rails 73*a* fixed to the slide frame 72. On the slide frame 72, an electric motor 73*b* is mounted, and a pair of ball screws 73*d*, 73*d* which are driven by the electric motor 73*b* via a bevel gear 73*c* are rotatably supported. Each of the ball screws 73*d* is inserted in a threaded manner into a nut 73*e* which is fixed to each of the movable frames 73. In this manner, both the movable frames 73, 73 can be moved toward, and away from, each other in the direction in which both the second and third sides WOc, WOd face each other.

The normal direction of the clamping positions in which the second and third clamping devices $71_2$, $71_3$ clamp the bent edge portion WOa of the above-described sides WOc, WOd varies with the degree of curving of both the sides WOc, WOd. Therefore, the second and third clamping devices $71_2$, $71_3$ are supported on each of the movable frames 73 so as to be rotatable about an axis in the longitudinal direction of each of the clamping devices $71_2$, $71_3$. When the clamping claws 71*b*, 71*c* of each of the clamping devices $71_2$, $71_3$ are closed, each of the clamping devices $71_2$, $71_3$ is rotated to follow the direction of the clamping position of the bent edge portion WOa. The bent edge portion WOa can thus be surely clamped in the normal direction of the clamping position. An inner race 71*f* which is mounted on an upper end of each of the clamping devices $71_2$, $71_3$ is inserted from a lower side into an outer race 71*g* which is fixed to the movable frame 73. A nut 71*h* is attached in a threaded manner to an upper end of the inner race 71*f* so as to prevent the inner race 71*f* from being pulled out of position. Each of the clamping devices $71_2$, $71_3$ is thus rotatably supported by the movable frame 73. Further, on a lower end of the outer race 71*g*, a stopper 71*j* is attached so that a square flange 71*i* on a lower end of the inner race 71*f* comes into abutment therewith. It is thus so arranged that each of the clamping devices $71_2$, $71_3$ can be rotated within a range of a predetermined angle. In the present embodiment, the first clamping device $71_1$ is rotatably supported on the base frame 70*a* in the same rotatably supporting construction as explained hereinabove. However, what is clamped by the first clamping device $71_1$ is the bent edge portion WOa of the first side WOb which is straight. Therefore, the first clamping device $71_1$ may be fixed to the base frame 70*a*.

The above-described workpiece discharging robot 10 is movable along guide rails 10*a* between a right door WR discharging position on the side of the first hemming apparatus $6_1$ and a left door WL discharging position on the side of the second hemming apparatus $6_2$. The welding station S5 is disposed near the left door WL discharging position. In case the door to be discharged is the right door WR, the workpiece discharging robot 10 is moved to the right door WR discharging position. The door WR is then discharged from the first hemming apparatus $\mathbf{6}_1$ by means of the robot hand 100. The workpiece discharging robot 10 is then moved to the left door WL discharging position to feed the door into the welding station S5. In case the door to be discharged is the left door WL, the workpiece discharging robot 10 is maintained in the left door WL discharging position. The door is taken out of the second hemming apparatus $\mathbf{6}_2$ by means of the robot hand 100 to feed the door into the welding station S5. The robot hand 100 is of the same construction as the robot hand 50 of the inner element transfer robot 5. Namely, it has first through third, i.e., a total of three, holding devices for holding the hole edge portions of the above-described three holes WIa, WIb, WIc of the door inner elements WRI, WLI of each of the doors WR, WL. Therefore, detailed explanation of the robot hand 100 is omitted. The robot hand 50 of the inner element transfer robot 5 and the robot hand 100 of the workpiece discharging robot 10 can be used commonly for both the left door WL and the right door WR. However, when the door is changed from the front door to the rear door, or when the door has been changed to the door for another kind of vehicle, the robot hand 50, 100 must be replaced.

Figure 9:
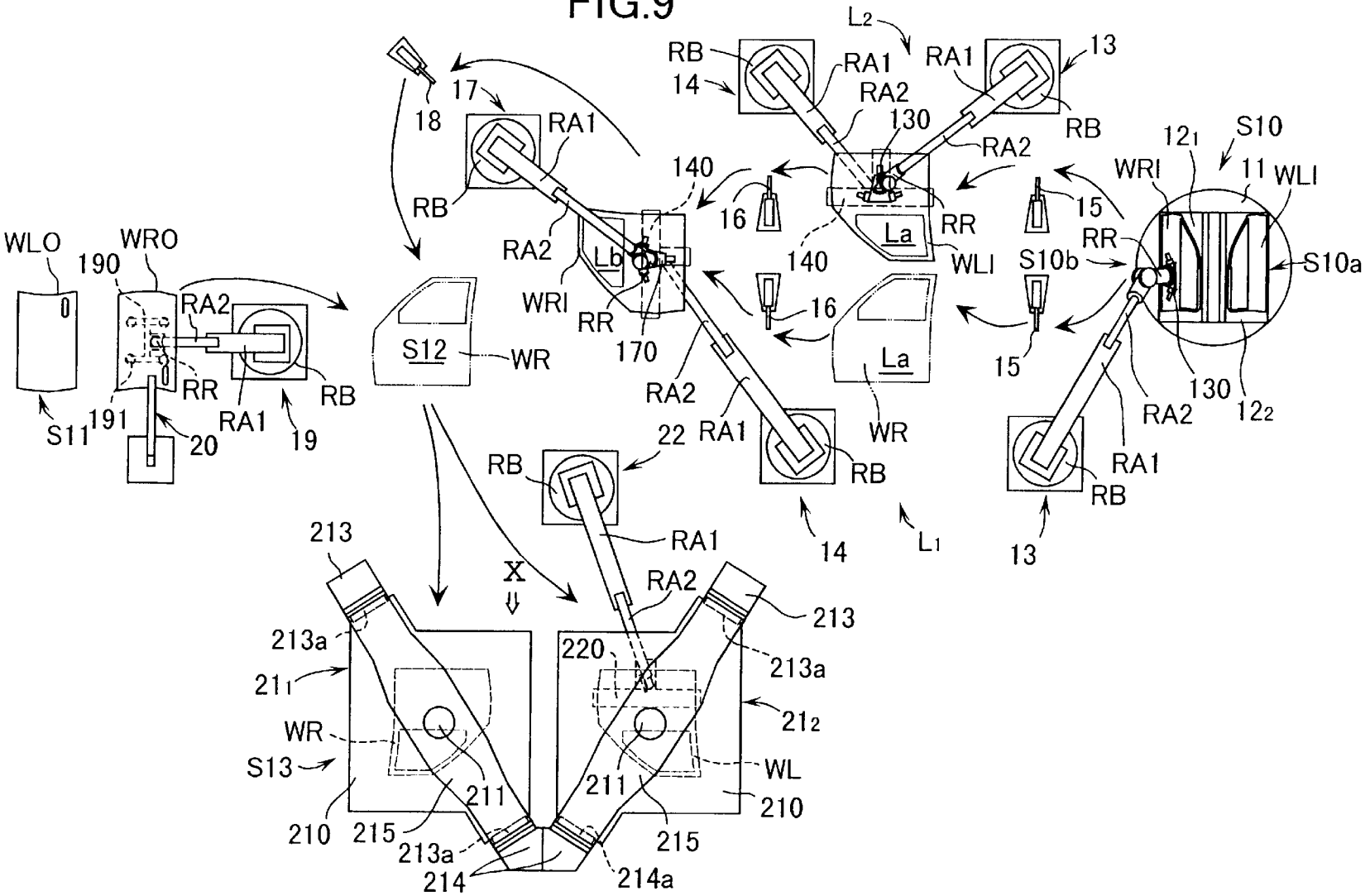
FIG. 9 is a plan view of a second embodiment of an apparatus for manufacturing doors to which the present invention is applied.

FIG. 9 shows a second embodiment of the apparatus for manufacturing doors of the present invention. This apparatus is provided with the following: i.e., an inner member assembly station S10 for assembling the door inner elements; a pair of first inner member working line $L_1$ for the right door and second inner member working line $L_2$ for the left door for respectively performing required works on the door inner elements; an outer member feeding station S11 for feeding door outer panels; a subassembly station S12 for combining the door outer panels and the door inner elements together to subassemble the doors; and a hemming station S13 for hemming bent edge portions on an outer periphery of the door outer panel, whereby the door outer panel and the door inner elements are integrated together.

In the inner member assembly station S10, there is disposed a turn table 11. On this turn table 11, there are disposed a first inner member setting jig $\mathbf{12}_1$ and a second inner member setting jig $\mathbf{12}_2$ in a back to back relationship. The first inner member setting jig $\mathbf{12}_1$ is capable of setting thereon, in a desired positional relationship, a plurality of door inner element constituting parts such as a door inner panel, a sash, a stiffener, a beam, or the like of the door inner element WRI for the right door. The second inner member setting jig $\mathbf{12}_2$ is capable of setting thereon, in a desired positional relationship, a plurality of door inner element constituting parts of the door inner element WLI for the left door. By turning the turn table 11, both the inner member setting jigs $\mathbf{12}_1$, $\mathbf{12}_2$ can be alternately rotated to a setting position S10*a* on one diametrical side of the turn table 11 and a welding position S10*b* on the diametrically opposite side of the turn table 11. At the setting position S10*a*, the door inner element constituting parts of the door which corresponds to each of the inner member setting jigs $\mathbf{12}_1$, $\mathbf{12}_2$ are manually set in position. At the welding position S10*b*, the door inner element constituting parts are welded together on each of the inner member setting jigs $\mathbf{12}_1$, $\mathbf{12}_2$ by means of a suspended type of welding robot (not illustrated). The door inner elements WRI for the right door and the door inner elements WLI for the left door are thus alternately assembled.

In each of the inner member working lines $L_1$, $L_2$, there are disposed two stages, i.e., front stage and rear stage, of transfer robots 13, 14 for transferring the door inner elements WRI, WLI. By the transfer robot 13 on the front stage the door inner element WRI, WLI is picked up or taken out from the inner member setting jig $\mathbf{12}_1$, $\mathbf{12}_2$ which is located in the welding position S10*b*. The door inner element WRI, WLI is then transferred to a hand-over position La which lies in an intermediate position of each of the inner member working lines $L_1$, $L_2$. At this hand-over position La the door inner element WRI, WLI is handed over from the transfer robot 13 on the front stage to the transfer robot 14 on the rear stage. By the transfer robot 14 on the rear stage the door inner element WRI, WLI is transferred to a common discharging position Lb at the end of both the inner member working lines $L_1$, $L_2$.

Stationary type of welding guns 15, 16 are disposed in the passages of transfer of the door inner element WRI, WLI, by each of the transfer robots 13, 14. The door inner element WRI, WLI is moved relative to each of the welding guns 15, 16 by each of the transfer robots 13, 14. The connecting portions which have been left unwelded at the inner member assembly station S10 are additionally welded as reinforcing welding by each of the welding guns 15, 16.

Into the above-described discharging position Lb there will be alternately transferred or fed the door inner element WRI for the right door and the door inner element WLI for the left door. At the discharging position Lb the door inner element WRI, WLI is transferred from the transfer robot 14 on the rear stage to the inner member transfer robot 17, generically called as an inner member transfer apparatus, which is common to the right door WRI and the left door WLI. The door inner element WRI for the right door and the door inner element WLI for the left door are alternately transferred into the subassembly station S12 by the inner member transfer robot 17. A teaching has been made such that the inner member transfer robot 17 transfers the door inner element WRI, WLI to the subassembly station S12 via the position where a stationary type of welding gun 18 is disposed. Even in the process of transferring by the inner member transfer robot 17, the door inner element WRI, WLI can be subjected to the reinforcing welding work. It is thus so arranged that the number of reinforcing welding in the first and second inner member working lines $L_1$, $L_2$ can be reduced, i.e., that the cycle time can be shortened.

Into the above-described outer member feeding station S11, there are alternately transferred or fed the door outer panel WRO for the right door and the door outer panel WLO for the left door. The door outer panel WRO for the right door and the door outer panel WLO for the left door are alternately transferred from the outer member feeding station S11 to the subassembly station S12 by an outer member transfer robot 19, generically called as an outer member transfer apparatus, which is common to the right door and the left door. Further, in a passage for transfer of the door outer panel WRO, WLO by the outer member transfer robot 19, there is disposed a stationary type of apparatus for applying a sealing agent 20. The door outer panel WRO, WLO is moved by the outer member transfer robot 19 relative to the apparatus for applying a sealing agent 20. The sealing agent is thus applied to the portions connecting the door outer panel WRO, WLO to the door inner element WRI, WLI.

The outer member transfer robot 19 is arranged to hold by suction an outer surface of the door outer panel WRO, WLO. The door outer panel WRO, WLO is transferred into the subassembly station S12 in a horizontal posture in which the inner surface of the door outer panel WRO, WLO looks upward. On the above-described inner member setting jigs $\mathbf{12}_1$, $\mathbf{12}_2$, the door inner element constituting parts are set in such a way that the door inner panel is positioned on the outside of the other door inner member constituting parts. The door inner element WRI, WLI is held by the transfer robot 13 on the front stage, from the side of the outer surface of the door inner panel. The door inner element WRI, WLI is held by the transfer robot 14 on the rear stage, from the side of the inner surface of the door inner panel. The door inner element WRI, WLI is held again by the inner member transfer robot 17 from the side of the outer surface of the door inner panel. The door inner element WRI, WLI is transferred into the subassembly station S12 by the inner member transfer robot 17 in a horizontal posture in which the inner surface of the door inner element looks downward. The door inner element WRI, WLI is combined, from an upper side, to the door outer panel WRO, WLO which is held in a horizontal posture by the outer member transfer robot 19. The right door WR and the left door WL are thus alternately subassembled.

In the above-described hemming station S13, a first hemming apparatus $\mathbf{21}_1$ adapted for the right door WR and a second hemming apparatus $\mathbf{21}_2$ adapted for the left door WL are disposed in a side by side relationship with each other relative to the subassembly station S12. The right door WR and the left door WL alternately subassembled in the subassembly station S12 are alternately fed to the first hemming apparatus $\mathbf{21}_1$ and the second hemming apparatus $\mathbf{21}_2$ via a common workpiece feeding robot 22 which is disposed between the subassembly station S12 and the hemming station S13. The hemming work of the right door WR by the first hemming apparatus $\mathbf{21}_1$ and the hemming work of the left door LR by the second hemming apparatus $\mathbf{21}_2$ are alternately performed.

Figure 10:
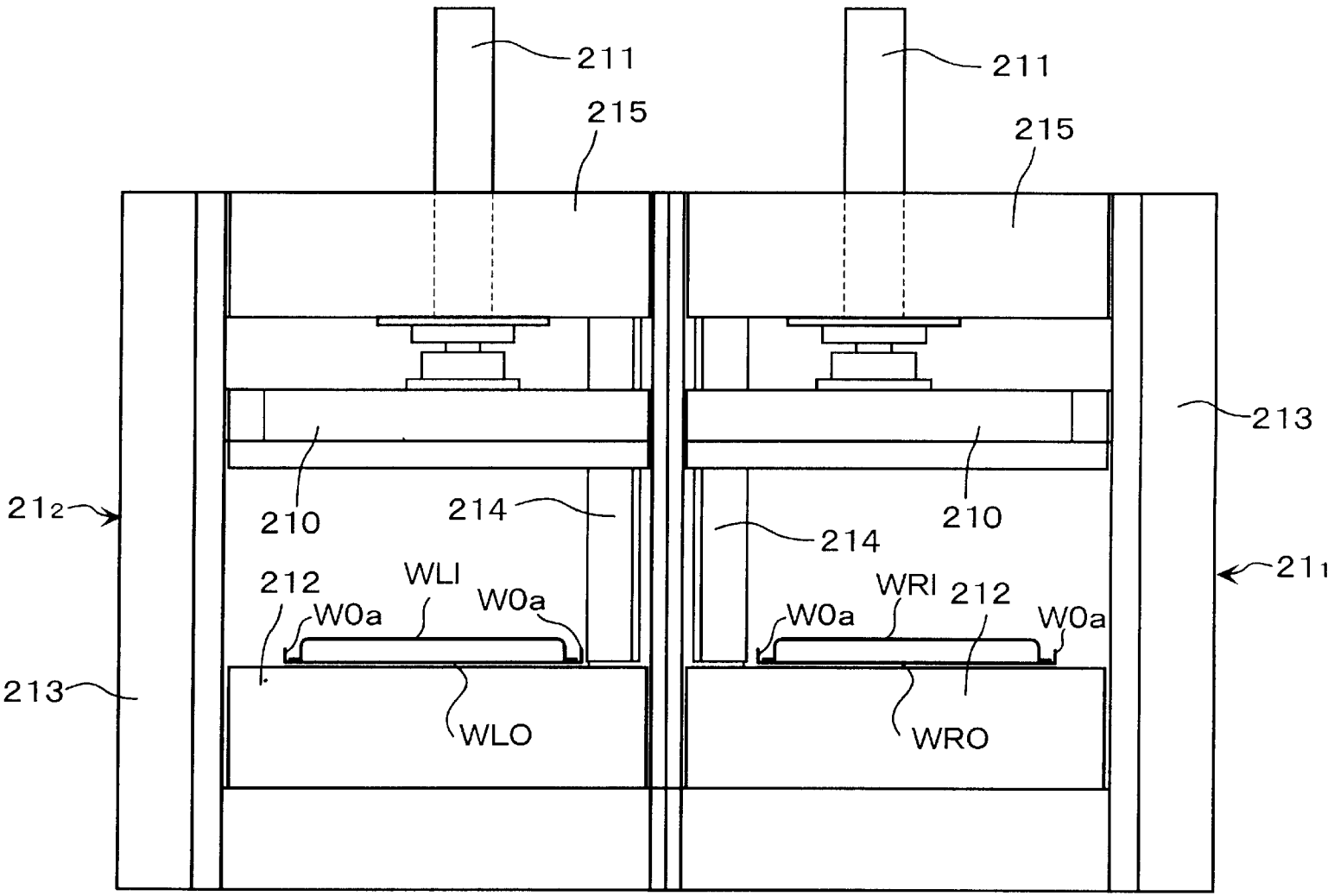
FIG. 10 is a front view of a hemming station as viewed in the direction of an arrow X in FIG. 9.

As shown in FIG. 10, each of the hemming apparatuses $\mathbf{21}_1$, $\mathbf{21}_2$ is constituted by a hydraulic press in which a ram 210 is moved up and down by a hydraulic cylinder 211. A bent edge portion WOa of the door outer panel WRO, WLO of the door WR, WL which are set in position on a hemming die 212 is subjected to the hemming work via a hemming punch (not illustrated) by the downward movement of the ram 210. In each of the hemming apparatuses $\mathbf{21}_1$, $\mathbf{21}_2$, supporting columns 213, 214 are vertically provided only in two diagonal corner positions. The ram 210 is suspended via the hydraulic cylinder 211 from an upper beam 215 which diagonally extends between both the supporting columns 213, 214. Diagonal corner portions of the ram 210 are slidably engaged with guide rails 213*a*, 214*a* which are fixed to the supporting columns 213, 214 to thereby guide the upward and downward movement of the ram 210. Both the hemming apparatuses $\mathbf{21}_1$, $\mathbf{21}_2$ are disposed in a side by side relationship with each other in such a manner that the upper beams 215, 215 are connected together into a V-shape which opens toward the side in which the workpiece feeding robot 22 is disposed. According to this arrangement, on the face which looks toward the workpiece feeding robot 22, the columns 213, 213 are present only on both outside as seen in the direction in which the hemming apparatuses $\mathbf{21}_1$, $\mathbf{21}_2$ are disposed in a side by side relationship with each other. The space between the columns 213, 213 is an open space without a supporting column at all. In this manner, by disposing the workpiece feeding robot 22 in the intermediate portion as seen in the direction of in which the hemming apparatuses $\mathbf{21}_1$, $\mathbf{21}_2$ are disposed in a side by side relationship with each other, the following becomes possible. Namely, the right door WR and the left door WL can be alternately fed to the hemming apparatuses $\mathbf{21}_1$, $\mathbf{21}_2$ without interfering with the supporting columns even if the workpiece feeding robot 22 is not shifted in position toward the first hemming apparatus $\mathbf{21}_1$ or toward the second hemming apparatus $\mathbf{21}_2$. In the intermediate portion on the discharging side of the hemming apparatuses $\mathbf{21}_1$, $\mathbf{21}_2$, there are present the supporting columns 214, 214. Therefore, a workpiece discharging robot (not illustrated) is respectively provided for the right door and for the left door so that the door WR, WL from each of the hemming apparatuses $\mathbf{21}_1$, $\mathbf{21}_2$ can be discharged. Though not illustrated, a valve for upward and downward movement is respectively connected to the hydraulic cylinder 211, 211 of the hemming apparatuses $\mathbf{21}_1$, $\mathbf{21}_2$. In the same manner as in the first embodiment shown in FIG. 2, hydraulic pressure from a common hydraulic pressure source is selectively supplied via a changeover valve to the hemming apparatuses $\mathbf{21}_1$, $\mathbf{21}_2$.

In the same manner as each of the robots 5, 7 in the first embodiment, each of the above-described robots 13, 14, 17, 19, 22 is constituted by a 6-axis robot which has the following: namely, a robot main body RB which is rotatable about a vertical axis; a first robot arm RA1 which is mounted on an upper end of the robot main body RB so as to be swingable about a horizontal axis; a second robot arm RA2 which is mounted on a front end of the first robot arm RA1 so as to be swingable about a horizontal axis; and a 3-axis wrist RR which is provided on a front end of the second robot RA2. A robot hand 130, 140, 170, 190, 220 is respectively provided on the wrist RR of each of the robots 13, 14, 17, 19, 22, the wrist being generically called an operating end. The robot hand 170 of the inner member transfer robot 17 which is common to the door inner element WRI for the right door WR and the door inner element WLI for the left door WL is of the same construction as the robot hand 50 of the inner member transfer robot 5 as shown in FIG. 3. It is constituted to hold the hole edge portions of three holes WIa, WIb, WIc out of a plurality of holes formed in the door inner panel of the door inner element WRI, WLI. Therefore, its detailed explanation is omitted.

The robot hand 130 of the transfer robot 13 on the front stage in each of the inner member working lines $L_1$, $L_2$ is also constituted, in a similar manner as the above-described robot hand 170, to hold the door inner element WRI, WLI by the hole edge portions of the plurality of holes. The robot hand 140 of the robot 14 on the rear stage is constituted to hold the door inner element WRI, WLI at such edge portions of the door inner panel which do not overlap with the holding portion of the transfer robot 13 on the front stage. The following arrangement may also be made. Namely, a bench for the door inner element is provided at the handover position La and at the discharging position Lb, respectively. The door inner element is placed on each bench at the handover position La and at the discharging position Lb by the transfer robot 13 on the front stage and by the transfer robot 14 on the rear stage. Thereafter, the door inner element is picked up from each bench at the handover position La and at the discharging position Lb by the transfer robot 14 on the rear stage and by the inner member transfer robot 17. In this case, the robot hand 140 of the transfer robot 14 on the rear stage may also be constituted into the type in which the door inner element is held by the hole edge portions of the plurality of holes. The robot hand 190 of the outer member transfer robot 19 is provided with a plurality of suction cups 191. The door outer panel WRO, WLO is held at its outer surface by suction with these suction cups 191.

The robot hand 220 of the workpiece feeding robot 22 is of the same construction as that of the robot hand 70 of the workpiece feeding robot 7 in the above-described first embodiment. It is arranged to clamp the bent edge portions WOa in the three sides WOb, WOc, WOd of the door outer panel WRO, WLO. Therefore, its detailed explanation is omitted.

As explained hereinabove, at the subassembly station S12, the door inner element WRI, WLI is combined by the inner member transfer robot 17 with the door outer panel WRO, WLO which is held by the outer member transfer robot 19. Then, the inner member transfer robot 17 is retreated from the subassembly station S12. Also, the robot hand 220 of the workpiece feeding robot 22 is moved into the subassembly station S12. Each of the subassembled doors WR, WL is received by the workpiece transfer robot 22, and each of the doors WR, WL is fed to the respective hemming apparatus $\mathbf{21}_1$, $\mathbf{21}_2$.

In the apparatus of the second embodiment, the following procedures are also followed. Namely, while discharging the right door WR from the first hemming apparatus $\mathbf{21}_1$ and while feeding the next right door WR into the first hemming apparatus $\mathbf{21}_1$, the steps of closing the hemming dies, keeping the hemming dies under pressure, and opening the hemming dies of the second hemming apparatus $\mathbf{6}_2$ are performed. Then, while discharging the left door WL from the second hemming apparatus $\mathbf{21}_2$ and while feeding the next left door WL into the second hemming apparatus $\mathbf{21}_2$, the steps of closing the hemming dies, keeping the hemming dies under pressure, and opening the hemming dies of the first hemming apparatus $\mathbf{21}_1$ are performed. The above-described steps are repeated to thereby alternately hem the right door WR and the left door WL.

Figure 11:
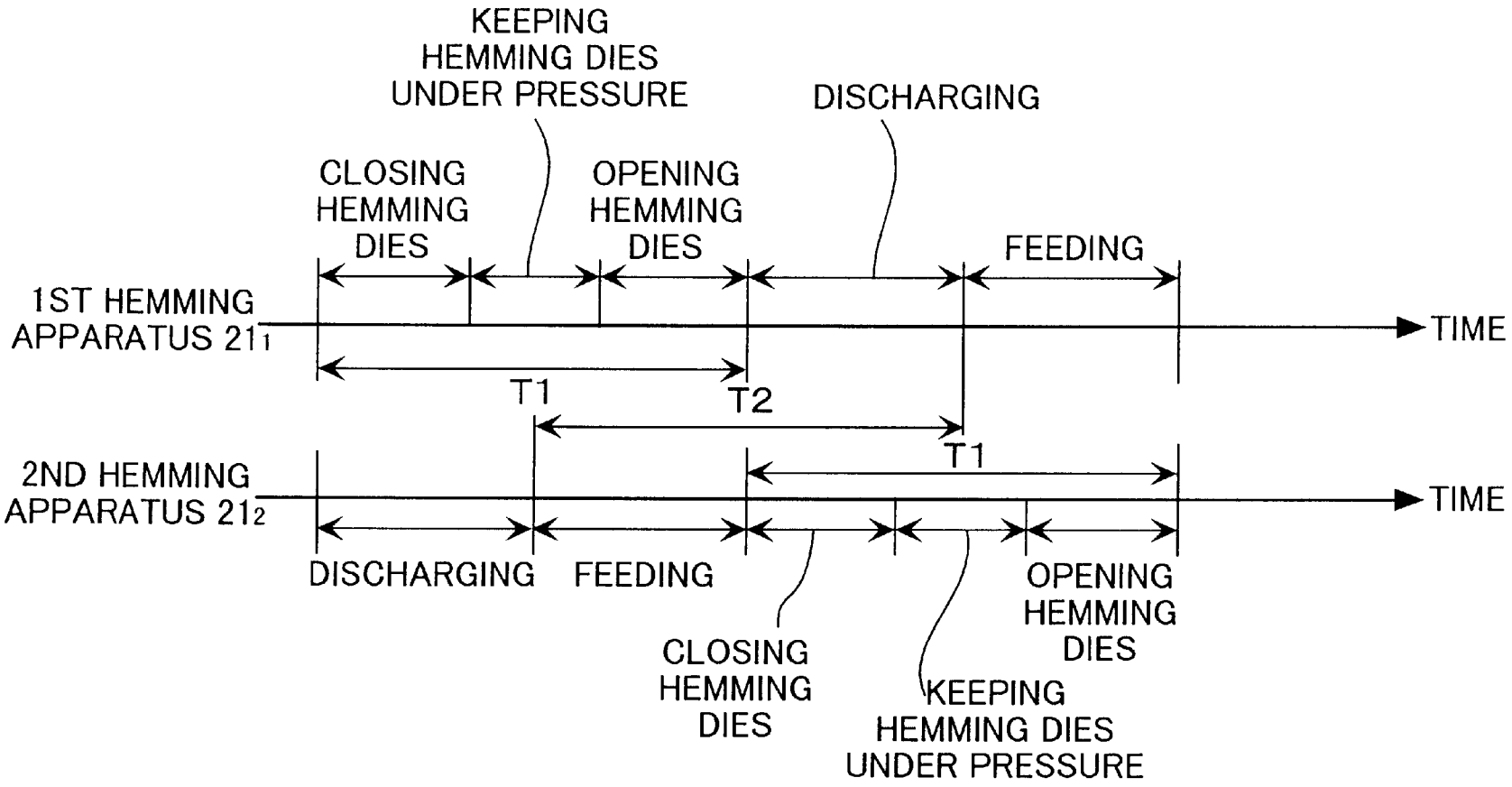
FIG. 11 is a time chart showing the timing of each step of the hemming work.

FIG. 11 shows the timing of each of the steps of closing the hemming dies, holding the hemming dies under pressure, opening the hemming dies, discharging the doors, and feeding the doors. Let the time required from the start of the step of closing the hemming dies to the completion of the step of opening the hemming dies be T1 (about 20 seconds). Then, in order to alternately manufacture the right door WR and the left door WL at a time interval of T1, a time T2 which is required from the time of feeding the door into one of the hemming apparatuses $\mathbf{21}_1$, $\mathbf{21}_2$ to the time of feeding the door into the other of the hemming apparatuses $\mathbf{21}_1$, $\mathbf{21}_2$ must be kept below T1. Like in the above-described first embodiment, in case the workpiece feeding robot 7 is shifted to the side of the hemming apparatus $\mathbf{6}_1$ for the right door and to the side of the hemming apparatus $\mathbf{6}_2$ for the left door to thereby feed each of the doors WR, WL into the respective hemming apparatuses $\mathbf{6}_1$, $\mathbf{6}_2$, the time T2 becomes slightly longer than T1. On the other hand, in the present second embodiment, the doors WR, WL can be fed to both the hemming apparatuses $\mathbf{6}_1$, $\mathbf{6}_2$ without shifting the position of the workpiece transfer robot 22. The time T2 can therefore be made shorter than T0 and, as a consequence, the right doors WR and the left doors WL can be efficiently manufactured at a time interval of T1.

In the above-described second embodiment, the transfer of the door inner element WRI, WLI in the inner member working lines $L_1$, $L_2$ is performed by the robot 13, 14. It is also possible to transfer the door inner element WRI, WLI by a conveyor apparatus. Similarly, a common outer member transfer apparatus for transferring the door outer panel WRO, WLO from the outer member feeding station S11 to the subassembly station S12 may be constituted by the conveyor apparatus as in the above-described first embodiment. However, the freedom in the design of the manufacturing lines can advantageously increases if, as in the above-described second embodiment, the door inner element and door outer element are transferred by the robots.

In the above-described first and second embodiments, the present invention is applied to the apparatus for manufacturing the right door and the left door for the vehicle. The present invention can similarly be applied to the manufacturing of the hemmed front and rear lid-shaped workpieces for a vehicle such as a bonnet and a trunk lid, or a bonnet and a tail gate.

It is readily apparent that the above-described apparatus for manufacturing hemmed workpieces meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. An apparatus for manufacturing hemmed workpieces which are of two kinds in different shapes formed by integrating an outer member and an inner member by hemming, said apparatus comprising:

a common subassembly station for alternately subassembling two kinds of workpieces by combining the outer member and the inner member together;

a hemming station having disposed therein in a side by side relationship relative to said subassembly station a first hemming apparatus adapted for a first kind of workpiece and a second hemming apparatus adapted for a second kind of workpiece;

a common workpiece feeding robot for feeding the first kind of workpiece and the second kind of workpiece subassembled in said subassembly station alternately into said first hemming apparatus and said second hemming apparatus;

wherein, while discharging a workpiece and feeding a next workpiece in one of said first and second hemming apparatuses, hemming steps from closing hemming dies to opening the hemming dies are performed in the other of said first and second hemming apparatuses.

2. The apparatus for manufacturing hemmed workpieces according to claim 1, wherein said workpiece feeding robot further comprises a robot hand mounted at an operating end of said robot, said robot hand having a plurality of clamping devices for clamping bent edge portions of a plurality of sides on a periphery of the outer member of each of the workpieces.

3. The apparatus for manufacturing hemmed workpieces according to claim 2, wherein said clamping devices are made up of: a first clamping device for clamping a bent edge portion of a predetermined side of the outer member; second and third clamping devices for clamping bent edge portions of those two oppositely positioned sides of the outer member which face each other in a longitudinal direction in which said predetermined side extends; and wherein each of said second and third clamping devices is mounted on each of movable frames which are supported in a manner movable in the direction in which both the sides face each other, and in the longitudinal direction in which both said sides extend.

4. The apparatus for manufacturing hemmed workpieces according to claim 3, wherein each of said second and third clamping devices is supported on each of said movable frames so as to be rotatable about an axis which extends in a longitudinal direction of each of said second and third clamping devices.

5. The apparatus for manufacturing hemmed workpieces according to any one of claims 2 through 4, wherein each of said clamping devices further comprises a pair of clamping claws provided so as to be opened and closed, one of said pair of clamping claws having a projection and the other thereof having a recession such that the bent edge portion of the outer member is clamped in a partially deformed manner between said projection and said recession.

6. The apparatus for manufacturing hemmed workpieces according to claim 1, wherein each of said first and second hemming apparatuses is constituted by a hydraulic press and wherein hydraulic pressure is selectively supplied from a common hydraulic pressure source to both said hemming apparatuses via a common changeover valve.

7. The apparatus for manufacturing hemmed workpieces according to claim 1, wherein each of said first and second hemming apparatuses is constituted by a hydraulic press comprising supporting columns vertically provided only on diagonally opposite two corners and a ram suspended via a hydraulic cylinder from an upper beam extended between said two supporting columns, and wherein both said hemming apparatuses are disposed in a side by side relationship with each other in such a manner that said upper beams of both said hemming apparatuses are arranged into a V-shape opening toward a side in which the workpiece feeding robot is disposed.

8. The apparatus for manufacturing hemmed workpieces according to claim 1, further comprising:

a common outer member transfer apparatus which alternately transfers the outer member for the first kind of workpiece and the outer member for the second kind of workpiece into the subassembly station; and an inner member transfer apparatus which alternately transfers the inner member for the first kind of workpiece and the inner member for the second kind of workpiece into the subassembly station, wherein the inner member is combined by the inner member transfer apparatus into the outer member transferred into the subassembly station.

9. The apparatus for manufacturing hemmed workpieces according to claim 8, further comprising:

a common inner member assembly station having a pair of inner member setting jigs respectively for the first kind of workpiece and for the second kind of workpiece, each of said inner member setting jigs being capable of setting a plurality of inner member constituting parts in a predetermined positional relationship and being disposed so as to be alternately changed in position between a setting position for performing setting work on each of said inner member setting jigs and a welding position for welding the plurality of inner member constituting parts on said inner member setting jigs to thereby assemble the inner member; and a pair of inner member working lines for the first kind of workpiece and for the second kind of workpiece for performing predetermined works on the inner member taken. out of the inner member setting jig positioned at the welding position;

wherein the inner member of the first kind of workpiece and the second kind of workpiece alternately discharged from both said inner member working lines are transferred to said subassembly station by said inner member transfer apparatus.

* * * * *